US009339686B2

(12) United States Patent
Yeh

(10) Patent No.: US 9,339,686 B2
(45) Date of Patent: May 17, 2016

(54) HIGH KNEES EXERCISE APPARATUS

(71) Applicant: PREVENTIVE MEDICAL HEALTH CARE CO., LTD., Taoyuan County (TW)

(72) Inventor: Ching-Yu Yeh, Taichung (TW)

(73) Assignee: PREVENTIVE MEDICAL HEALTH CARE CO., LTD., Taoyuan (TW)

( * ) Notice: Subject to any disclaimer, the term of this patent is extended or adjusted under 35 U.S.C. 154(b) by 169 days.

(21) Appl. No.: 13/902,946

(22) Filed: May 27, 2013

(65) Prior Publication Data

US 2014/0274580 A1 Sep. 18, 2014

(30) Foreign Application Priority Data

Mar. 18, 2013 (TW) ..... 102204977 U

(51) Int. Cl.

| | |
|---|---|
| ***A63B 22/06*** | (2006.01) |
| ***A63B 22/00*** | (2006.01) |
| ***A63B 21/00*** | (2006.01) |
| *A63B 21/22* | (2006.01) |
| *A63B 21/005* | (2006.01) |

(52) U.S. Cl.

CPC ..... *A63B 22/0605* (2013.01); *A63B 21/00192* (2013.01); *A63B 22/001* (2013.01); *A63B 22/0012* (2013.01); *A63B 22/0017* (2015.10); *A63B 22/0056* (2013.01); *A63B 22/06* (2013.01); *A63B 21/005* (2013.01); *A63B 21/225* (2013.01); *A63B 2022/0038* (2013.01); *A63B 2022/0041* (2013.01); *A63B 2022/0051* (2013.01); *A63B 2022/0688* (2013.01); *A63B 2208/0204* (2013.01); *A63B 2208/0233* (2013.01)

(58) Field of Classification Search

CPC ..... A63B 21/00192; A63B 21/225; A63B 22/001; A63B 22/0012; A63B 22/0056; A63B 22/06; A63B 22/0605; A63B 22/0664; A63B 23/02; A63B 23/0205; A63B 23/0216; A63B 23/0222; A63B 23/0227; A63B 2022/0017; A63B 2202/0041; A63B 2022/0051; A63B 2022/0688; A63B 2022/0038; A63B 2022/0611; A63B 2022/0635; A63B 2208/0204; A63B 2208/0233

USPC ..... 482/51–53, 57–65

See application file for complete search history.

(56) References Cited

U.S. PATENT DOCUMENTS

| | | | | | |
|---|---|---|---|---|---|
| 3,758,111 | A * | 9/1973 | Agamian | ..... | 482/57 |
| 3,759,511 | A * | 9/1973 | Zinkin | ..... | A63B 21/015 297/423.1 |
| 4,789,153 | A * | 12/1988 | Brown | ..... | 482/111 |
| 4,811,945 | A * | 3/1989 | Disbrow et al. | ..... | 482/63 |
| 5,000,443 | A * | 3/1991 | Dalebout et al. | ..... | 482/51 |

(Continued)

*Primary Examiner* — Oren Ginsberg
*Assistant Examiner* — Gregory Winter
(74) *Attorney, Agent, or Firm* — CKC & Partners Co., Ltd.

(57) ABSTRACT

A high knees exercise apparatus includes a base, two actuator members, and two pedals. The base includes a supporting member and a pivot portion. The pivot portion has a pivot axis. The actuator members are pivotally connected to two sides of the pivot portion respectively and moving in response to each other reversely. Each of the actuator members includes a lower portion swinging along an arc path centered on the pivot axis. The arc path includes a first arc extended from a virtual vertical line passing through the pivot axis and an angle of the first arc is 45 degrees to 100 degrees. Each of the pedals is pivotally connected to a free end of each of the lower portions.

14 Claims, 3 Drawing Sheets

(56) References Cited

U.S. PATENT DOCUMENTS

| | | | | |
|---|---|---|---|---|
| 5,163,886 | A * | 11/1992 | Seol | 482/57 |
| 5,599,257 | A * | 2/1997 | Lee | 482/51 |
| 5,709,633 | A * | 1/1998 | Sokol | 482/62 |
| 5,735,778 | A * | 4/1998 | Piaget | 482/114 |
| 6,244,989 | B1 * | 6/2001 | Chen | 482/57 |
| 6,669,603 | B1 * | 12/2003 | Forcillo | 482/57 |
| 8,267,843 | B2 * | 9/2012 | Dellino | 482/137 |
| 8,529,413 | B2 * | 9/2013 | Simmons | 482/100 |
| 9,155,933 | B2 * | 10/2015 | Yeh | A63B 21/00192 |
| 9,180,331 | B1 * | 11/2015 | Yeh | A63B 21/02 |
| 2006/0100070 | A1 * | 5/2006 | Abdo | 482/121 |
| 2006/0252607 | A1 * | 11/2006 | Holloway | 482/62 |
| 2008/0261780 | A1 * | 10/2008 | Giannelli et al. | 482/52 |
| 2009/0124472 | A1 * | 5/2009 | Chou | 482/142 |

* cited by examiner

HIGH KNEES EXERCISE APPARATUS

RELATED APPLICATIONS

The application claims priority to Taiwan Application Serial Number 102204977, filed Mar. 18, 2013, which is herein incorporated by reference.

BACKGROUND

1. Field of Invention

The present disclosure relates to an exercise apparatus. More particularly, the present disclosure relates to a high knees exercise apparatus.

2. Description of Related Art

Exercise apparatuses make raining day and limited ground no longer be problems of doing exercise. Therefore, exercise apparatuses are main priority for modern people who are always busy but want to keep in shape. It is well-known that walking and running are body exercise which not only can burn calories and firm muscles but also can enhance myocardial function and increase lung capacity. Accordingly, treadmills, steppers, and elliptical trainers are most common exercise apparatus compared to others on the present market. However, users barely lift their knees high when using those exercise apparatus and improvements of muscle strength and body shape are mostly concentrated on their calf only.

High knees exercise is usually taken as a component of warm-up exercise to get heart rate going and also can burn calories and firm muscles as walking and running. This exaggerated knee motion further provides an excellent workout for the knees, hips, lower body, lower abdomen, and lower back and can enhance body strength, speed, balance, and flexibility. But, no apparatus for executing high knees exercise has been developed nowadays.

SUMMARY

According to one aspect of the present disclosure, a high knees exercise apparatus includes a base, two actuator members, and two pedals. The base includes a supporting member and a pivot portion. The pivot portion adjacent to the supporting member and has a pivot axis. The actuator members are pivotally connected to two sides of the pivot portion respectively and moving in response to each other reversely. Each of the actuator members includes a lower portion swinging along an arc path centered on the pivot axis. The arc path includes a first arc extended from a virtual vertical line passing through the pivot axis and an angle of the first arc is 45 degrees to 100 degrees. Each of the pedals is pivotally connected to a free end of each of the lower portions. The supporting member is disposed between the actuator members.

According to another aspect of the present disclosure, a high knees exercise apparatus includes a base, two actuator members, two pedals, a flywheel, and a resistance unit. The base includes a supporting member, a pivot portion, and a holder. The pivot portion is adjacent to the supporting member and has a pivot axis. The holder is located in front of the supporting member. The actuator members are pivotally connected to two sides of the pivot portion respectively and moving in response to each other reversely. Each of the actuator embers includes a lower portion and an upper portion. The lower portion swings along an arc path centered on the pivot axis. The arc path includes a first arc extended from a virtual vertical line passing through the pivot axis and an angle of the first arc is 45 degrees to 100 degrees. The upper portion is linked up with the lower portion and one end of the upper portion is provided with a hand grip which is flexible. A first included angle is formed between the lower portion and the virtual vertical line. A second included angle is formed between the upper portion and the virtual vertical line. The first included angle is 50 degrees to 60 degrees, and the second included angle is 20 degrees to 60 degrees. Each of the pedals is pivotally connected to a free end of each of the lower portions. The flywheel is attached to the base for stabilizing a moving speed of the actuator members and a weight of the flywheel is 0.1 kg to 5 kg. The resistance unit is attached to the base for imposing a resistance on the flywheel. The supporting member is disposed between the actuator members.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
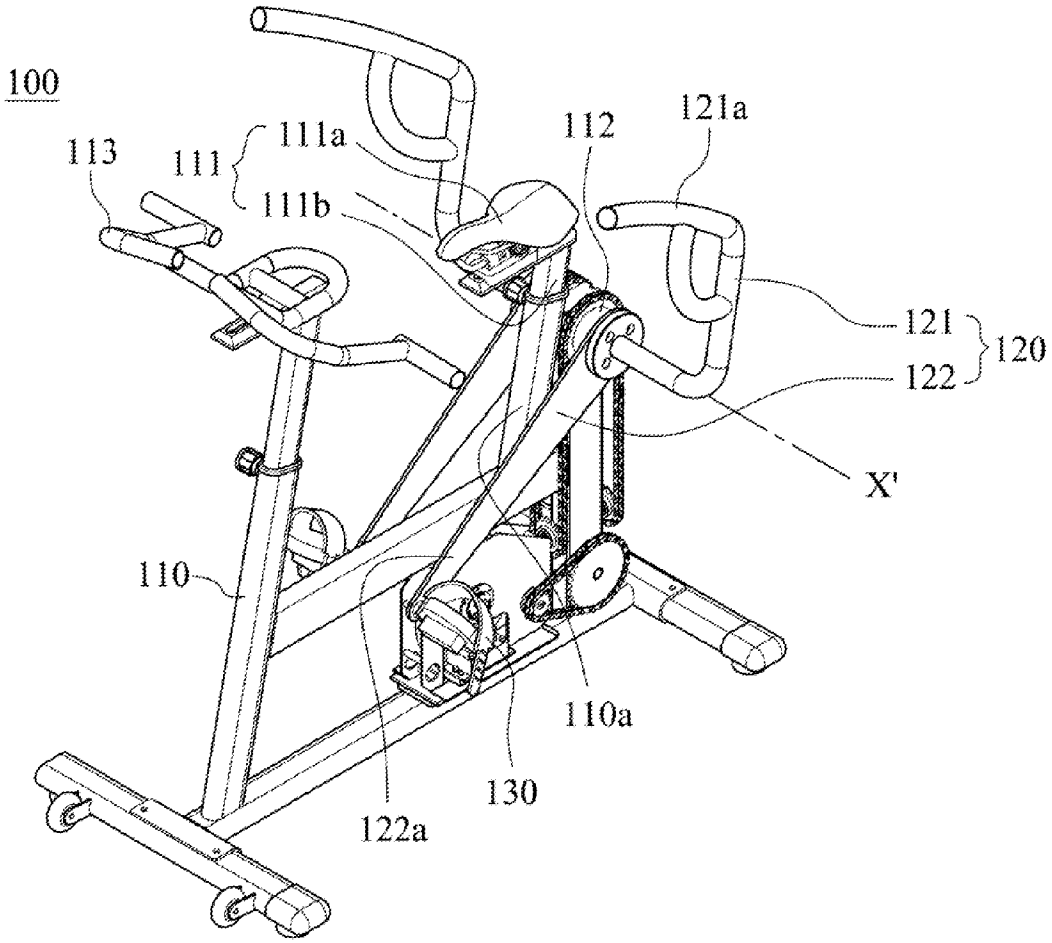
FIG. 1 is a three dimensional view of a high knees exercise apparatus according to one embodiment of the present disclosure.

FIG. 1 is a three dimensional view of a high knees exercise apparatus 100 according to one embodiment of the present disclosure. In FIG. 1, the high knees exercise apparatus 100 includes a base 110, two actuator members 120, and two pedals 130.

The base 110 includes a seat tube 110*a*, a supporting member 111, a pivot portion 112, and a holder 113. The pivot portion 112 is adjacent to the supporting member 111 and has a pivot axis X'. The supporting member 111 includes a saddle 111*a* for a user to sit on and a seatpost 111*b* on which the saddle 111*a* is mounted, the seatpost 111*b* being disposed in the seat tube 110*a*. The holder 113 is located in front of the supporting member 111. The actuator members 120 are pivotally connected to two sides of the pivot portion 112 respectively and the supporting member 111 is disposed between the actuator members 120. Each of the actuator members 120 includes an upper portion 121 and a lower portion 122. The upper portion 121 is linked up with the lower portion 122. Specifically, the upper portion 121 of the actuator member 120 will move in response to movement of the lower portion 122 of the actuator member 120 and vice versa. In other words, no matter which one of the upper portion 121 and the lower portion 122 is driven to move, the other will move simultaneously. Thus, users can operate the actuator members 120 by driving the lower portion 122 or the upper portion 121. In addition, each of the pedals 130 is pivotally connected to a free end 122*a* of each of the lower portions 122, so that the foot of users can rest or be attached on.

Figure 2:
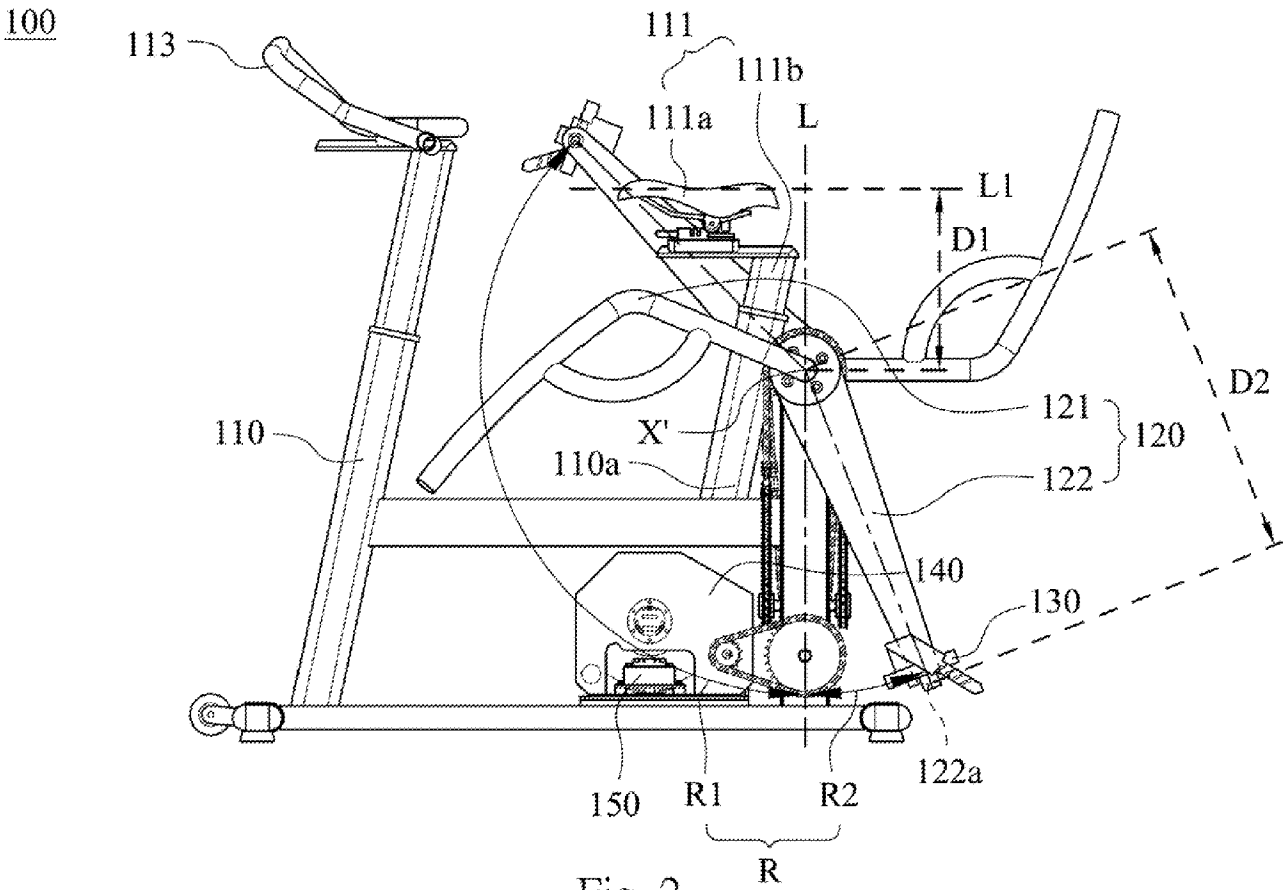
FIG. 2 is a schematic view of the operation of the high knees exercise apparatus of FIG. 1.

FIG. 2 is a schematic view of the operation of the high knees exercise apparatus 100 of FIG. 1. In FIG. 2, the actuator members 120 move in response to each other reversely. Specifically, the actuator members 120 move in response to each other in a reverse direction when they are operated by users. Furthermore, the lower portion 122 swings along an arc path R centered on the pivot axis X' when the actuator member 120 is operated. Specifically, the lower portion 122 swings by taking the pivot axis X' as a fulcrum and then the arc path R is provided. The arc path R includes a first arc R1 and a second arc R2. The first arc R1 is extended from a virtual vertical line L passing through the pivot axis X' and an angle of the first arc R1 is preferably 45 degrees to 100 degrees. Thus, user can execute high knees exercise in situ by the high knees exercise apparatus 100 that provides an excellent workout for the knees, hips, lower body, lower abdomen, and lower back and also enhances body strength, speed, balance, and flexibility.

On the other hand, the second arc R2 is connected to the first arc R1 and reversely extended from the virtual vertical line L. Specifically, the arc path R is divided into the first arc R1 and the second arc R2 by the virtual vertical line L. An angle of the second arc R2 is preferably greater than 0 degrees and at most 10 degrees. Thus, users can execute high knees exercise in a greater extent. The supporting member 111, for example, is a saddle or a backrest which users can sit on or lean against when operating the high knees exercise apparatus 100. Moreover, users can hold the holder 113 located in front of the supporting member 111 to get on the supporting member 111 or users can let their upper body lying on the holder 113 to facilitate stretch of legs for driving the lower portions 122 fully swings along the arc path R, especially along a path of the second arc R2.

The high knees exercise apparatus 100 further includes a flywheel 140 and a resistance unit 150. The flywheel 140 is attached to the base 110 for stabilizing a moving speed of the actuator members 120 that makes the swing of the actuator members 120 more smooth.

The resistance unit 150 is attached to the base 110 for imposing a resistance on the flywheel 140 that makes the inertia of the high knees exercise apparatus 100 can be decreased to almost zero. Thus, users will feel like no apparatus existed when executing high knees exercise by the high knees exercise apparatus 100. A weight of the flywheel 140 is preferably 0.1 kg to 5 kg and more preferably 3 kg. The resistance unit 150, for example, is a magnetic damper and so on.

Figure 3:
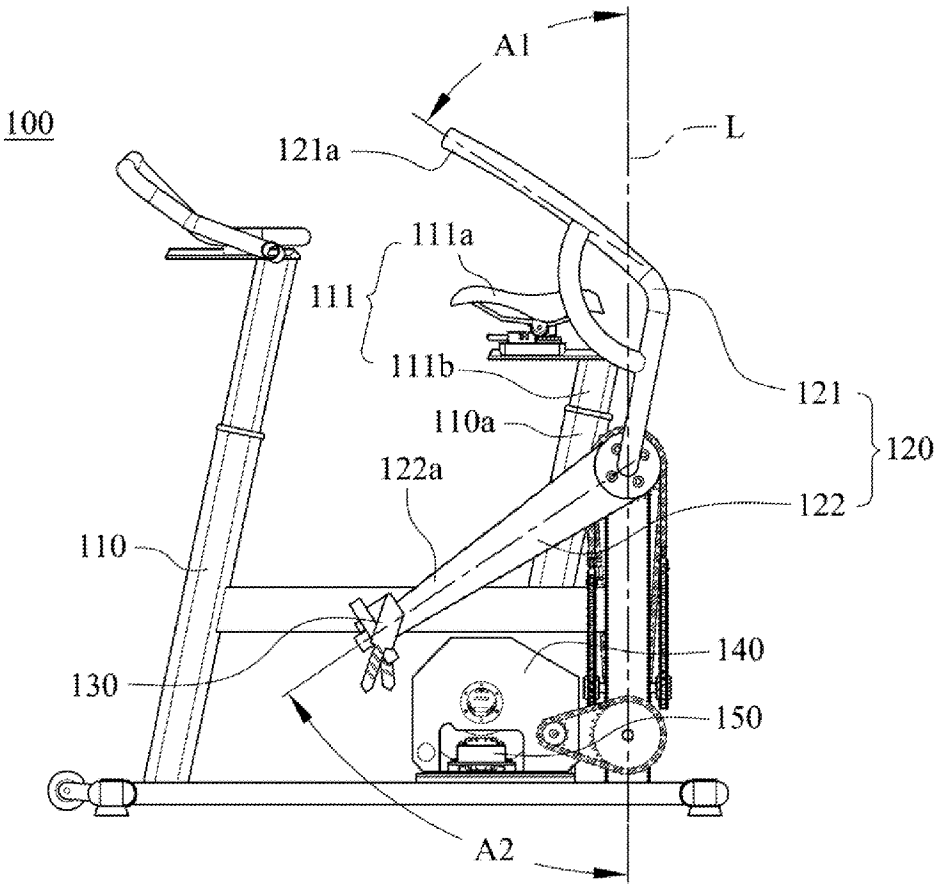
FIG. 3 is a side view of the high knees exercise apparatus of FIG. 1.

FIG. 3 is a side view of the high knees exercise apparatus 100 of FIG. 1. In FIG. 3, one end of the upper portion 121 is provided with a hand grip 121*a*. The hand grip 121*a* is for users to grip while operating the actuator members 120. When the high knees exercise apparatus 100 is stationary, an included angle A1 is formed between the upper portion 121 and the virtual vertical line L and another included angle A2 is formed between the lower portion 122 and the virtual vertical line L. Specifically, the included angle A1 is formed between the hand grip 121*a* and the virtual vertical line L. The included angle A1 is at least 20 degrees, preferably 20 degrees to 60 degrees, and more preferably 55.3 degrees. The included angle A2 is at least 40 degrees, preferably 50 degrees to 60 degrees, and more preferably 56.25 degrees. Thus, users can keep an adequate pose first after getting on the high knees exercise apparatus 100 and then executing the high knees exercise.

The hand grip 121*a* is flexible and capable of adapting varied operated angle. In other words, the hand grip 121*a* will deform slightly with the operation of the actuator members 120 by users. Thus, the operation of the high knees exercise apparatus 100 is ergonomic. The hand grip 121*a*, for example, is made of polyurethane. The supporting member 111 is rotatable and can adapt the movement of users' hip when they execute high knees exercise that also makes the high knees exercise apparatus 100 ergonomic. Furthermore, when users lift their knees high by the high knees exercise apparatus 100 they can also swing their arms and spread their elbow and shoulder because the upper portion 121 is linked up with the lower portion 122. Thus, the coordination of users' hands and feet can be improved.

Specifically, in this embodiment, the hand grip 121*a* and the lower portion 122 are disposed on two planes respectively and the planes are parallel to each other. The included angle A1 is an angle between horizontal projections of the hand grip 121*a* and the virtual vertical line L. A projection direction of those horizontal projections is identical to an extending direction of the pivot axis X'. In other embodiments of the present disclosure, the hand grip 121*a* and the lower portion 122 can be disposed on one plane.

Please refer back to FIG. 2. It is more important that the second arc R2 is not necessary for the arc path R. Specifically, users can execute high knees exercise and firm their muscles as long as the arc path R includes the first arc R1 having an angle of at least 45 degrees. The advantage of the arc path R further including the second arc R2 is that users can lift leg back and accomplish the high knees exercise perfectly. Accordingly, the exercise effects on muscles and body shape can be further improved. Furthermore, a distance D1 from the pivot axis X' of the pivot portion 112 to a virtual horizontal line L1 that is substantially perpendicular to the virtual vertical line L and that extends from the saddle 111*a* is smaller than a length D2 of the lower portion 122 of each of the actuator members 120 from the pivot axis X' to the free end 122*a* thereof.

Although the present disclosure has been described in considerable detail with reference to certain embodiments thereof, other embodiments are possible. Therefore, their spirit and scope of the appended claims should no be limited to the description of the embodiments contained herein.

It will be apparent to those skilled in the art that various modifications and variations can be made to the structure of the present disclosure without departing from the scope or spirit of the invention. In view of the foregoing, it is intended that the present disclosure cover modifications and variations of this invention provided they fall within the scope of the following claims,

What is claimed is:

1. A high knees exercise apparatus, comprising:

a base, comprising:

a seat tube;

a supporting member, wherein the supporting member comprises a saddle for a user to sit on and a seatpost on which the saddle is mounted, the seatpost being disposed in the seat tube; and a pivot portion adjacent to the seat tube and the supporting member and having a pivot axis;

two actuator members pivotally connected to two sides of the pivot portion respectively and reciprocally moving in response to each other reversely and simultaneously, each of the actuator members comprising:

a lower portion swinging along an arc path centered on the pivot axis, wherein the arc path comprises a first arc extended from a virtual vertical line passing through the pivot axis and substantially normal to a surface on which the high knees exercise apparatus is supported, and an angle of the first arc is 45 degrees to 100 degrees; and two pedals, each of the pedals pivotally connected to a free end of one of the lower portions;

wherein the supporting member is disposed between the actuator members;

wherein a distance from the pivot axis of the pivot portion to a virtual horizontal line that is substantially perpendicular to the virtual vertical line and that extends from the saddle is smaller than a length of the lower portion of each of the actuator members from the pivot axis to the free end thereof;

wherein the high knees exercise apparatus has a front and a rear in relation to the manner in which a user would be oriented on the high knees exercise apparatus to perform a high knees exercise, and the saddle is disposed between the front of the high knees apparatus and the virtual vertical line;

wherein when the high knees exercise apparatus is stationary and in a resting state, both of the lower portions are simultaneously at a first initial position and parallel to each other, an included angle is formed between each lower portion at the first initial position and the virtual vertical line, and the included angle is at least 40 degrees.

2. The high knees exercise apparatus of claim 1, wherein the arc path further comprises:

a second arc connected to the first arc and reversely extended from the virtual vertical line, wherein an angle of the second arc is greater than 0 degrees and at most 10 degrees.

3. The high knees exercise apparatus of claim 1, wherein the included angle is 50 degrees to 60 degrees.

4. The high knees exercise apparatus of claim 1, wherein each of the actuator members further comprises:

an upper portion linked with the lower PC ion of the actuator member, wherein one end of the upper portion is provided with a hand grip.

5. The high knees exercise apparatus of claim 4, wherein both of the upper portions are rested in a second initial position which are parallel to each other, a second included angle is formed between each upper portion in the second Initial position and the virtual vertical line.

6. The high knees exercise apparatus of claim 5, wherein the second included angle is 20 degrees to 60 degrees.

7. The high knees exercise apparatus of claim 4, wherein the hand grip is flexible.

8. The high knees exercise apparatus of claim 1, further comprising:

a flywheel attached to the base for stabilizing a moving speed of the actuator members.

9. The high knees exercise apparatus of claim 8, wherein a weight of the flywheel is 0.1 kg to 5 kg.

10. The high knees exercise apparatus of claim 9, wherein the weight of the flywheel is 3 kg.

11. The high knees exercise apparatus of claim 8, further comprising:

a resistance unit attached to the base for imposing a resistance on the flywheel.

12. The high knees exercise apparatus of claim 1, wherein the base further comprises:

a holder located ire front of the supporting member.

13. The high knees exercise apparatus of claim 1, wherein the supporting member is rotatable.

14. The high knees exercise apparatus oaf claim wherein the free end of each of the lower portions extends higher than the saddle of the supporting member when the lower portion swings to the end of the arc path away from the virtual vertical line.

* * * * *